US008800630B1

(12) United States Patent
Albanese et al.

(10) Patent No.: US 8,800,630 B1
(45) Date of Patent: Aug. 12, 2014

(54) TAPE DISPENSER DEVICE

(71) Applicants: Sola Albanese, Keswick (CA); Roseanne Set, Keswick (CA)

(72) Inventors: Sola Albanese, Keswick (CA); Roseanne Set, Keswick (CA)

( * ) Notice: Subject to any disclaimer, the term of this patent is extended or adjusted under 35 U.S.C. 154(b) by 26 days.

(21) Appl. No.: 13/732,794

(22) Filed: Jan. 2, 2013

(51) Int. Cl.
*B65H 35/07* (2006.01)
*B32B 37/10* (2006.01)
*B65H 35/00* (2006.01)

(52) U.S. Cl.
CPC ..... *B65H 35/0033* (2013.01); *B65H 35/0086* (2013.01)
USPC ..... 156/526; 156/577; 156/579

(58) Field of Classification Search
CPC ..... B65H 35/0033; B65H 35/002; B65H 35/008; B65H 35/0086; B65H 37/005
USPC ..... 156/526, 527, 574, 577, 579
See application file for complete search history.

(56) References Cited

U.S. PATENT DOCUMENTS 4,555,298 A * 11/1985 Boucher ..... 156/523
4,652,331 A * 3/1987 Plasencia ..... 156/526
5,549,255 A * 8/1996 Huang ..... 242/422.5
5,667,626 A 9/1997 Cayford et al.
5,735,999 A * 4/1998 Mendelovich et al. ..... 156/523
5,906,705 A * 5/1999 Chung et al. ..... 156/579
5,992,490 A 11/1999 Kakita et al.
6,098,690 A * 8/2000 Robichaud ..... 156/577
D453,355 S 2/2002 Potter et al.
6,398,619 B1 * 6/2002 Webb ..... 446/475
6,705,373 B1 * 3/2004 Yu Chen ..... 156/523
6,705,374 B2 * 3/2004 Yu Chen ..... 156/527
6,799,623 B1 * 10/2004 Cheng ..... 156/527
6,988,690 B2 1/2006 Hsu
7,201,201 B2 4/2007 Grenier
7,717,382 B2 5/2010 Whittemore et al.
2007/0210205 A1 * 9/2007 Tang ..... 242/588.2
2008/0156444 A1 7/2008 Pitzen et al.
2010/0307689 A1 * 12/2010 Huebner ..... 156/510
2011/0036503 A1 * 2/2011 Chen ..... 156/523

* cited by examiner

*Primary Examiner* — Mark A Osele

(57) ABSTRACT

A tape dispensing device dispenses and cuts tape to permit taping of elevated areas without a ladder or low areas without bending or kneeling. The device includes a first handle having an upper end and a lower end. A planar guard is pivotally coupled to the first handle. A retention spool is coupled to the guard wherein the retention spool is configured for holding a tape roll. A dispensing spool is coupled to the guard in spaced relationship to the retention spool. The dispensing spool is configured for abutting a back side of tape extending from the tape roll. The tape is dispensed onto a surface by rolling the dispensing spool against the surface with the tape being positioned between the dispensing spool and the surface. A cutting assembly is coupled to the guard and configured to selectively cut the tape extending from the tape roll.

16 Claims, 6 Drawing Sheets

TAPE DISPENSER DEVICE

BACKGROUND OF THE DISCLOSURE

Field of the Disclosure

The disclosure relates to tape dispenser devices and more particularly pertains to a new tape dispenser device for dispensing and cutting tape to permit taping of elevated areas without a ladder or low areas without bending or kneeling.

SUMMARY OF THE DISCLOSURE

An embodiment of the disclosure meets the needs presented above by generally comprising a first handle having an upper end and a lower end. A planar guard is pivotally coupled to the first handle. A retention spool is coupled to the guard wherein the retention spool is configured for holding a tape roll. A dispensing spool is coupled to the guard in spaced relationship to the retention spool wherein the dispensing spool is configured for abutting tape extending from the tape roll to dispense the tape onto a surface by rolling the dispensing spool against the surface. A cutting assembly is coupled to the guard. The cutting assembly is configured to selectively cut the tape extending from the tape roll.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
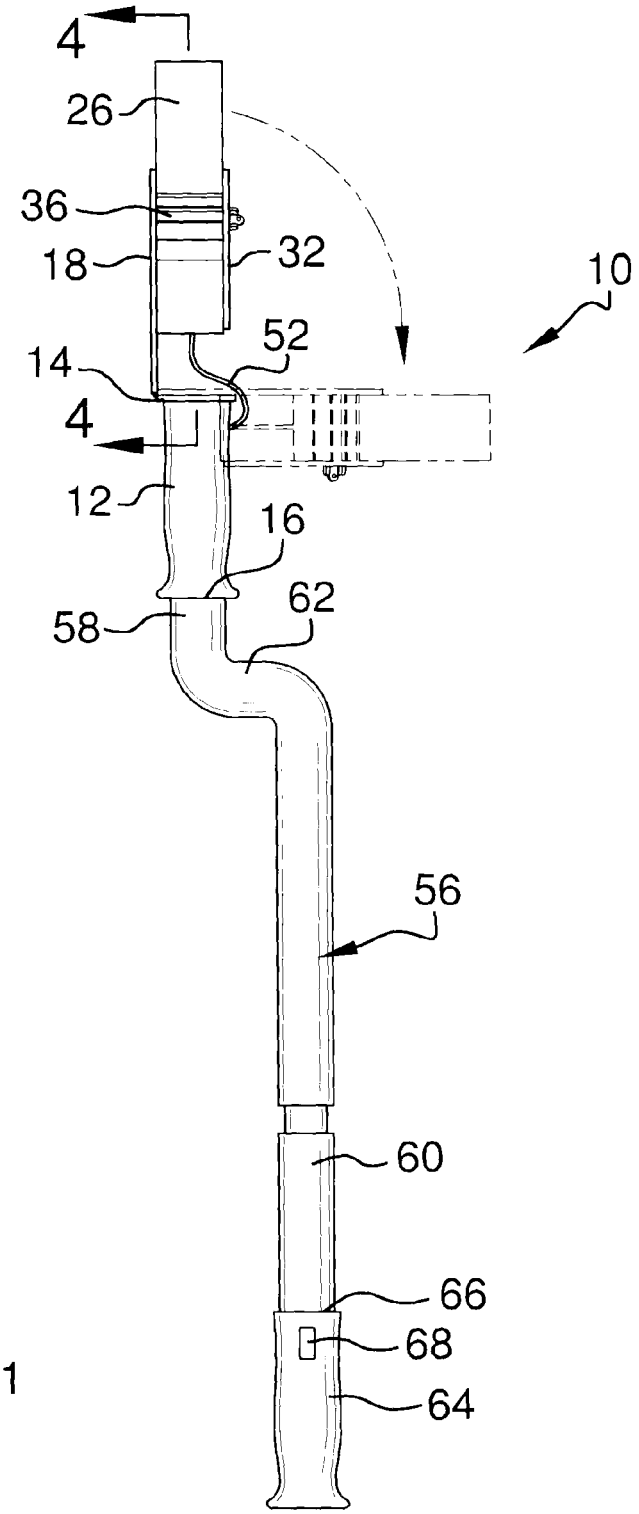
FIG. 1 is a front view of a tape dispensing device according to an embodiment of the disclosure.
Figure 2:
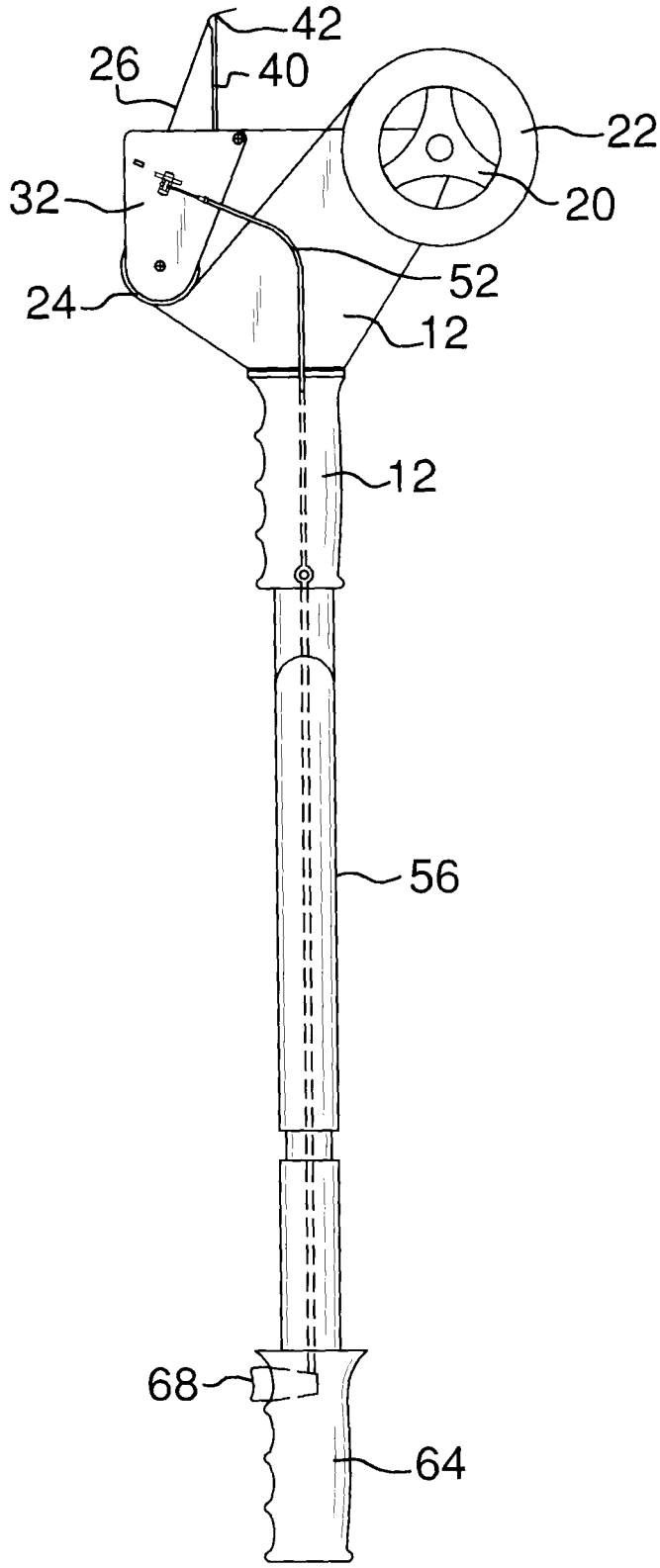
FIG. 2 is a side view of an embodiment of the disclosure.
Figure 3:
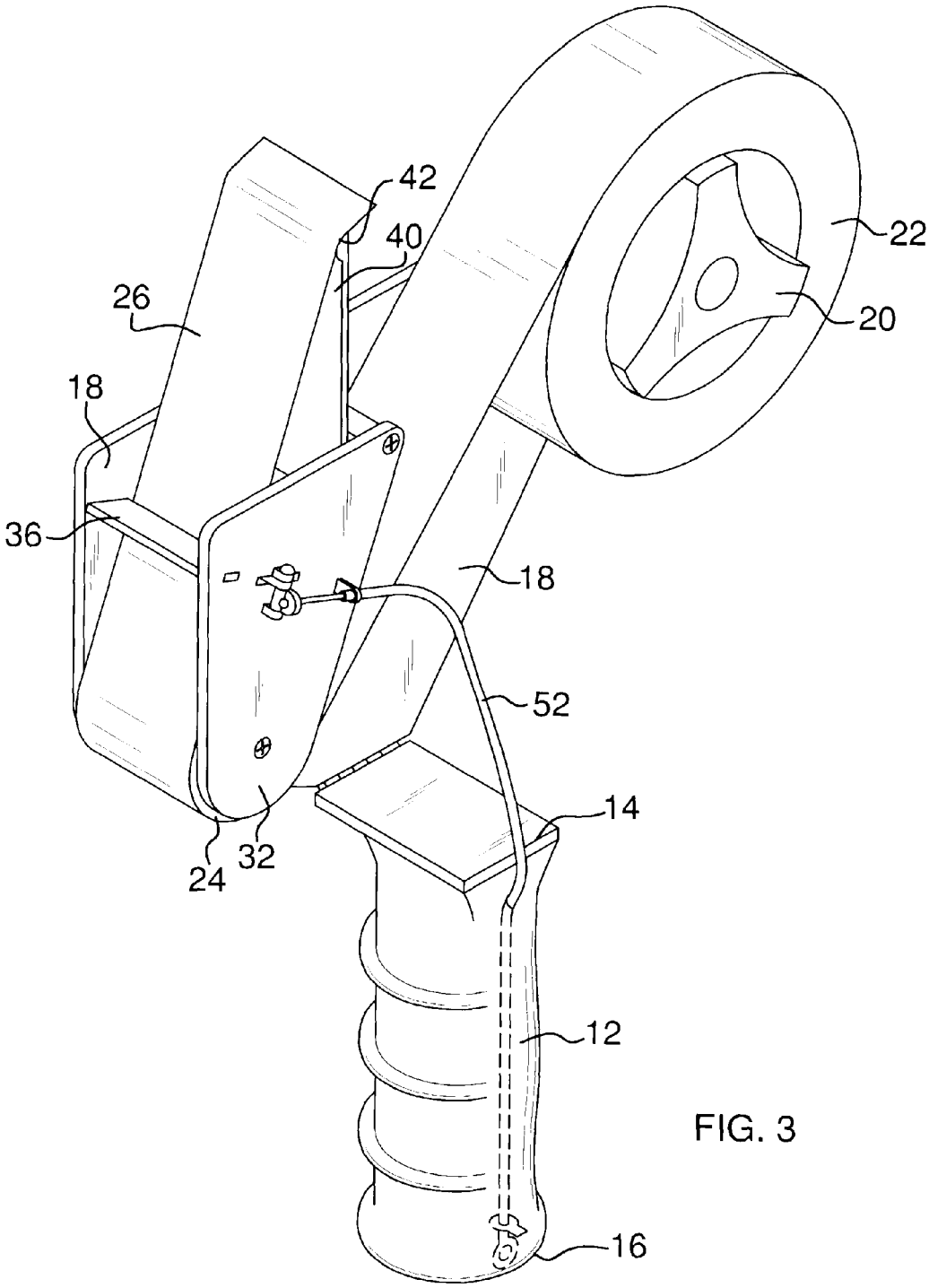
FIG. 3 is a top front side perspective view of an embodiment of the disclosure.
Figure 4:
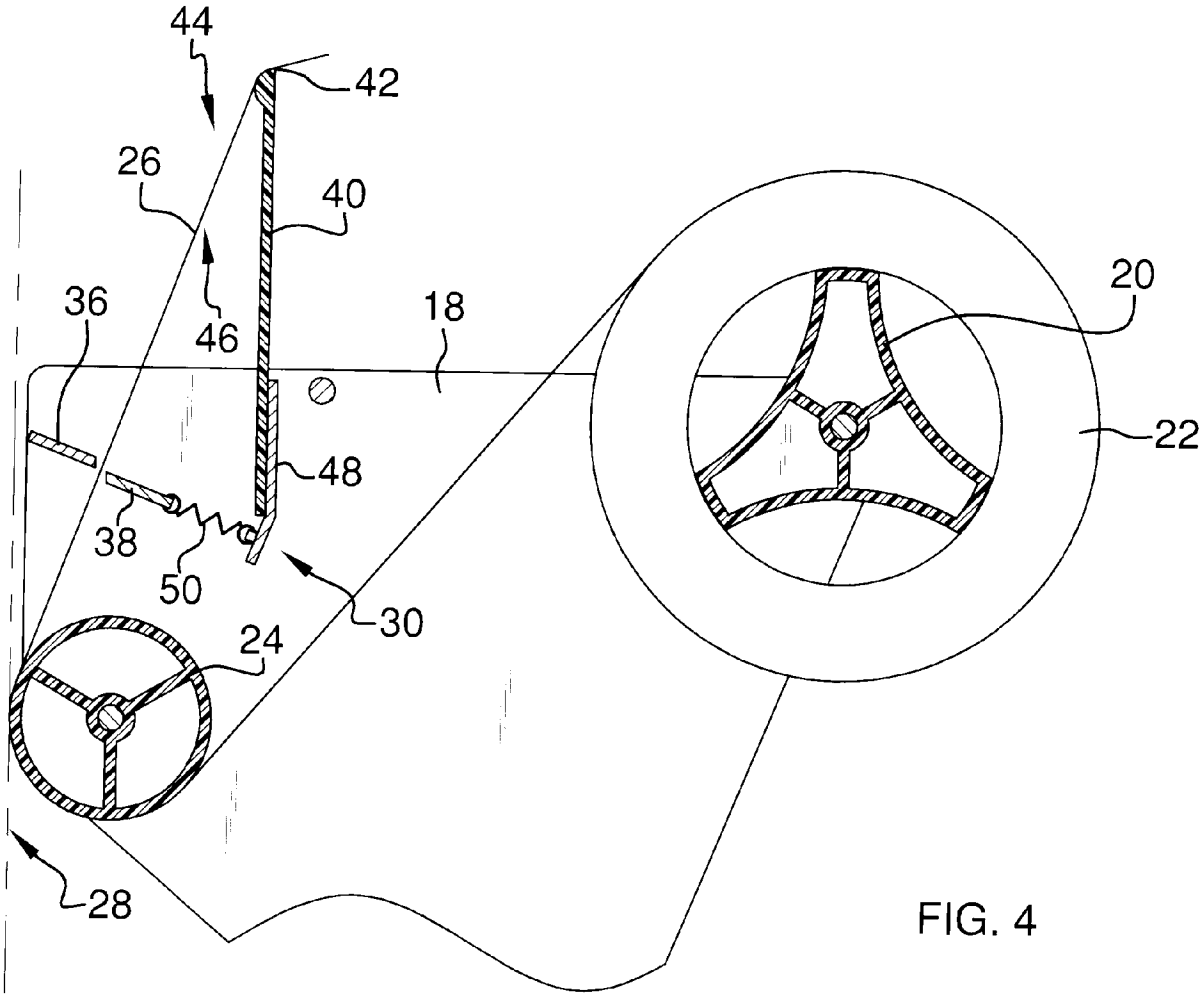
FIG. 4 is a cross-sectional view of an embodiment of the disclosure taken along line 4-4 of FIG. 1.
Figure 5:
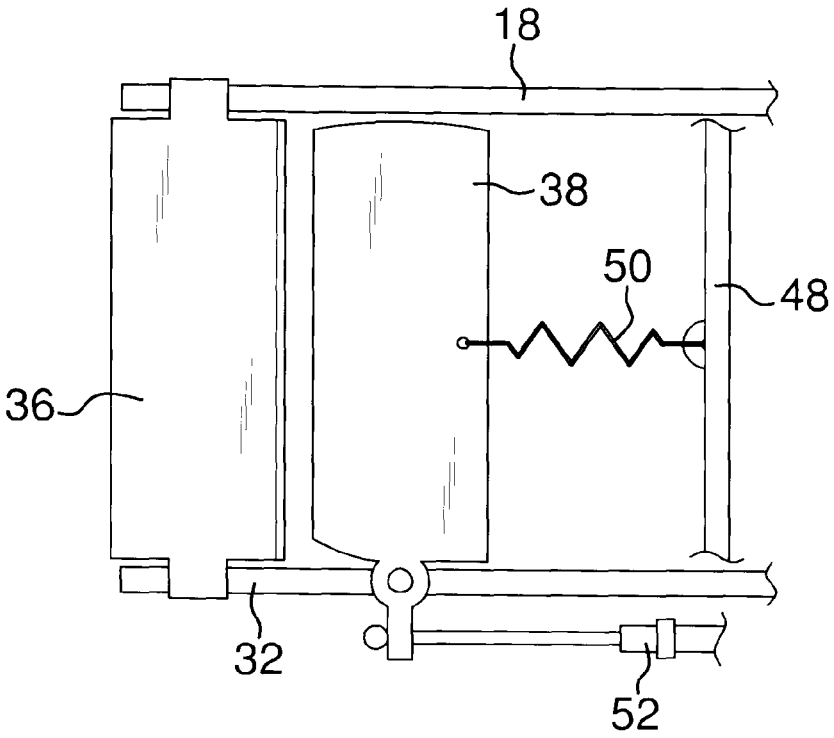
FIG. 5 is a top partial view of an embodiment of the disclosure.
Figure 6:
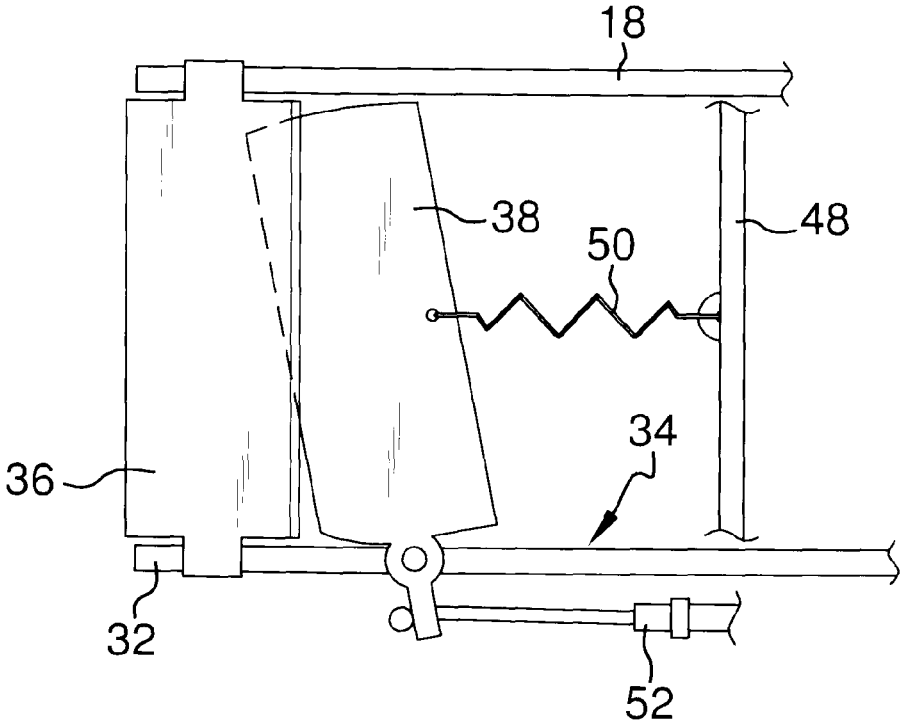
FIG. 6 is a top partial view of an embodiment of the disclosure.
Figure 7:
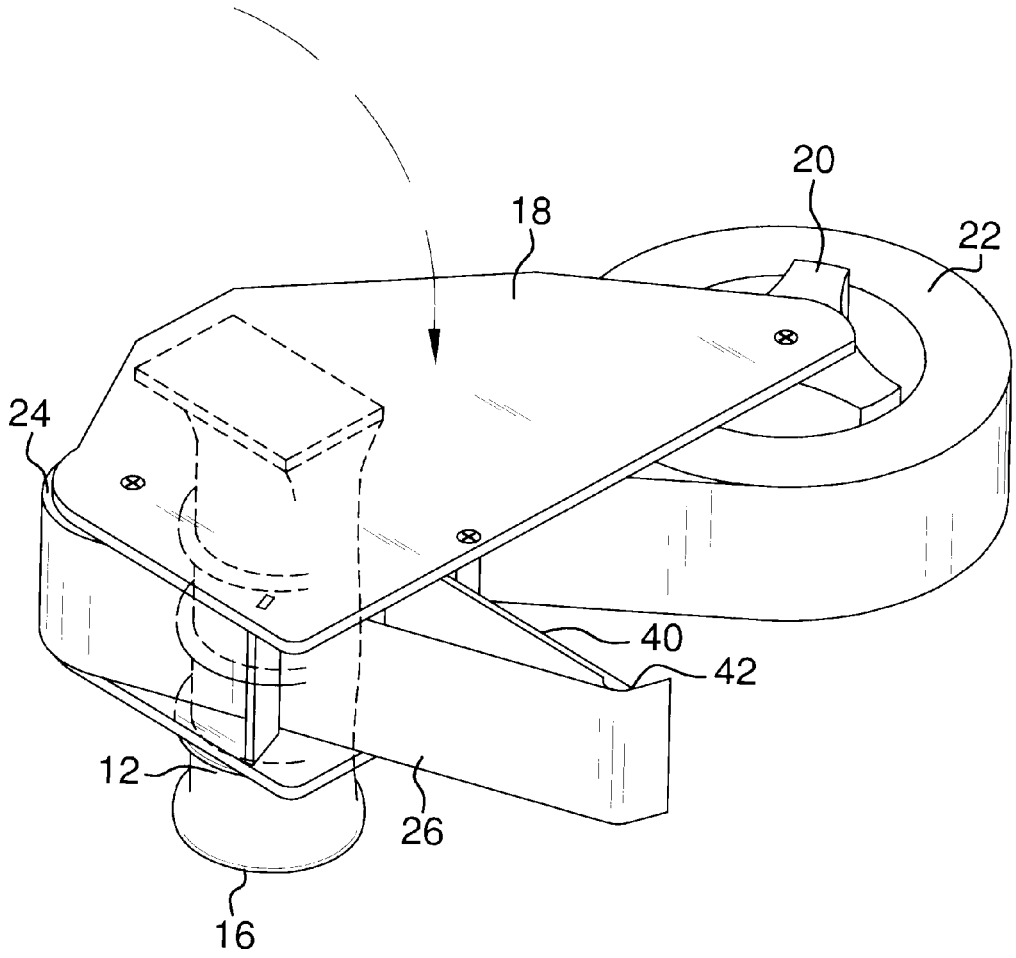
FIG. 7 is a top front side perspective view of an embodiment of the disclosure in a tilted position.

With reference now to the drawings, and in particular to FIGS. 1 through 7 thereof, a new tape dispenser device embodying the principles and concepts of an embodiment of the disclosure and generally designated by the reference numeral 10 will be described.

As best illustrated in FIGS. 1 through 7, the tape dispensing device 10 generally comprises a first handle 12 having an upper end 14 and a lower end 16. A planar guard 18 is pivotally coupled to the first handle 12. A retention spool 20 is coupled to the guard 18. The retention spool 20 is configured for holding a tape roll 22. A dispensing spool 24 is coupled to the guard 18 in spaced relationship to the retention spool 20. The dispensing spool 24 is configured for abutting a back side of tape 26 extending from the tape roll 22. The tape 26 is dispensed onto a surface 28 by rolling the dispensing spool 24 against the surface 28 with the tape 26 being positioned between the dispensing spool 24 and the surface 28. A cutting assembly 30 is coupled to the guard 18 and configured to selectively cut the tape 26 extending from the tape roll 22. A wall 32 is coupled to the guard 18 and positioned in spaced relationship to the guard 18. The wall 32 has a substantially planar surface 34 facing the guard 18. The dispensing spool 24 may be positioned between the guard 18 and the wall 32 wherein the tape 26 extending from the tape roll 22 is extendable between the guard 18 and the wall 32. The cutting assembly 30 may also be positioned between the guard 18 and the wall 32.

The cutting assembly 30 may include a stationary blade 36 coupled to and extending between the guard 18 and the wall 32. The cutting assembly 30 also comprises a pivoting blade 38 coupled to the wall 32 positioned adjacent to the stationary blade 36. The pivoting blade 38 is pivotable towards the stationary blade 36 wherein the cutting assembly 30 cuts the tape 26 extending from the tape roll 22 when the tape 26 is extended between the stationary blade 36 and the pivoting blade 38. A planar extension 40 may be coupled to and extend from the guard 18. The extension 40 has a first end 42 positioned in spaced relationship to the stationary blade 36. The cutting assembly 30 is positioned between the first end 42 of the extension 40 and the dispensing spool 24. The stationary blade 36 is positioned adjacent to a plane 44 extending between the first end 42 of the extension and the dispensing spool 24. The plane 44 is tangential to the dispensing spool 24. The pivoting blade 38 is positioned adjacent to the plane 44 on an opposite side 46 of the plane 44 from the stationary blade 36.

A brace 48 may be coupled to and extend between the guard 18 and the wall 32. A biasing member 50 is coupled to and extends between the brace 48 and the pivoting blade 38. The biasing member 50 urges the pivoting blade 38 away from the stationary blade 36. A cable 52 has a first end 54 coupled to the pivoting blade 38. The cable 52 pivots the pivoting blade 38 towards the stationary blade 36 by manipulation of the cable 52.

An extension handle 56 is couplable to the lower end 16 of the first handle 12. The extension handle 56 is telescopic. The extension handle 56 has a connection portion 58, a gripping portion 60, and an offset portion 62 extending between the connection portion 58 and the gripping portion 60. A grip 64 is coupled to a bottom portion 66 of the gripping portion 60 of the extension handle 56. A button 68 is coupled to the extension handle 56. The button 68 is couplable to the cable 52. This may employ an additional cable to permit extension of the telescopic extension handle 56 while maintain functionality for the button 68 wherein the cable 52 is selectively manipulated by depressing the button 68. The button 68 may be positioned on the grip 64.

In use, the tape roll 22 is loaded onto the retention spool 20 and the tape 26 threaded over the dispensing spool 24 and through the cutting assembly 30. The assembly 10 may be used by grasping the first handle 12 or after attachment of the extension handle 56. The planar guard 18 may be pivoted 90 degrees to facilitate application of the tape 26 to a vertical or horizontal surface. After the tape 26 has been affixed to the surface 28, the cable 52 is manipulated to actuate the cutting assembly 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A tape dispensing device comprising:

a first handle having an upper end and a lower end;

a planar guard pivotally coupled to said first handle;

a retention spool coupled to said guard, said retention spool being configured for holding a tape roll;

a dispensing spool coupled to said guard in spaced relationship to said retention spool wherein said dispensing spool is configured for abutting tape extending from the tape roll to dispense the tape onto a surface by rolling said dispensing spool against the surface; and a cutting assembly coupled to said guard, said cutting assembly being configured to selectively cut the tape extending from the tape roll.

2. The device of claim 1, further comprising:

a wall coupled to said guard, said wall being positioned in spaced relationship to said guard, said wall having a substantially planar surface facing said guard; and said dispensing spool being positioned between said guard and said wall wherein the tape extending from the tape roll is extendable between said guard and said wall.

3. The device of claim 2, further comprising said cutting assembly being positioned between said guard and said wall.

4. The device of claim 2, further comprising said cutting assembly comprising a stationary blade coupled to and extending between said guard and said wall.

5. The device of claim 4, further comprising said cutting assembly comprising a pivoting blade coupled to said wall, said pivoting blade being positioned adjacent to said stationary blade, said pivoting blade being pivotable towards said stationary blade wherein said cutting assembly is configured for cutting the tape extending from the tape roll when the tape is extended between said stationary blade and said pivoting blade.

6. The device of claim 4, further comprising a planar extension coupled to and extending from said guard, said extension having a first end positioned in spaced relationship to said stationary blade, said cutting assembly being positioned between said distal end of said extension and said dispensing spool.

7. The device of claim 6, further comprising said stationary blade being positioned adjacent to a plane extending between said first end of said extension and a said dispensing spool, said plane being tangential to said dispensing spool.

8. The device of claim 7, further comprising said pivoting blade being positioned adjacent to said plane on an opposite side of said plane from said stationary blade.

9. The device of claim 5, further comprising:

a brace coupled to and extending between said guard and said wall: and a biasing member coupled to and extending between said brace and said pivoting blade, said biasing member urging said pivoting blade away from said stationary blade.

10. The device of claim 9, further comprising a cable having a first end coupled to said pivoting blade, said cable pivoting said blade towards said stationary blade by manipulation of said cable.

11. The device of claim 1, further comprising an extension handle couplable to said lower end of said first handle.

12. The device of claim 11, further comprising said extension handle having a connection portion, a gripping portion, and an offset portion extending between said connection portion and said gripping portion.

13. The device of claim 11, further comprising:

a wall coupled to said guard, said wall being positioned in spaced relationship to said guard, said wall having a substantially planar surface facing said guard;

said dispensing spool being positioned between said guard and said wall wherein the tape extending from the tape roll is extendable between said guard and said wall;

said cutting assembly comprising a stationary blade coupled to and extending between said guard and said wall;

said cutting assembly comprising a pivoting blade coupled to said wall, said pivoting blade being positioned adjacent to said stationary blade, said pivoting blade being pivotable towards said stationary blade wherein said cutting assembly is configured for cutting the tape extending from the tape roll when the tape is extended between said stationary blade and said pivoting blade;

a cable having a first end coupled to said pivoting blade, said cable pivoting said blade towards said stationary blade by manipulation of said cable; and a button coupled to said extension handle, said button being couplable to said cable wherein said cable is selectively manipulated by depressing said button.

14. The device of claim 11, wherein said extension handle is telescopic.

15. The device of claim 12, further comprising a grip coupled to a bottom portion of said gripping portion of said extension handle.

16. A tape dispensing device comprising:

a first handle having an upper end and a lower end;

a planar guard pivotally coupled to said first handle;

a retention spool coupled to said guard, said retention spool being configured for holding a tape roll;

a dispensing spool coupled to said guard in spaced relationship to said retention spool wherein said dispensing spool is configured for abutting tape extending from the tape roll to dispense the tape onto a surface by rolling said dispensing spool against the surface;

a cutting assembly coupled to said guard, said cutting assembly being configured to selectively cut the tape extending from the tape roll, said cutting assembly comprising a stationary blade coupled to and extending between said guard and said wall, said cutting assembly comprising a pivoting blade coupled to said wall, said pivoting blade being positioned adjacent to said stationary blade, said pivoting blade being pivotable towards said stationary blade wherein said cutting assembly is configured for cutting the tape extending from the tape roll when the tape is extended between said stationary blade and said pivoting blade;

a wall coupled to said guard, said wall being positioned in spaced relationship to said guard, said wall having a substantially planar surface facing said guard, said dispensing spool being positioned between said guard and said wall wherein the tape extending from the tape roll is extendable between said guard and said wall, said cutting assembly being positioned between said guard and said wall;

a planar extension coupled to and extending from said guard, said extension having a first end positioned in spaced relationship to said stationary blade, said cutting assembly being positioned between said distal end of said extension and said dispensing spool, said stationary blade being positioned adjacent to a plane extending between said first end of said extension and a said dispensing spool, said plane being tangential to said dispensing spool, said pivoting blade being positioned adjacent to said plane on an opposite side of said plane from said stationary blade;

a brace coupled to and extending between said guard and said wall:

a biasing member coupled to and extending between said brace and said pivoting blade, said biasing member urging said pivoting blade away from said stationary blade;

a cable having a first end coupled to said pivoting blade, said cable pivoting said blade towards said stationary blade by manipulation of said cable;

an extension handle couplable to said lower end of said first handle, said extension handle being telescopic, said extension handle having a connection portion, a gripping portion, and an offset portion extending between said connection portion and said gripping portion;

a grip coupled to a bottom portion of said gripping portion of said extension handle; and a button coupled to said extension handle, said button being couplable to said cable wherein said cable is selectively manipulated by depressing said button, said button being positioned on said grip.

* * * * *